United States Patent [19]

Woodley

[11] 4,434,535

[45] Mar. 6, 1984

[54] CLOTHES PEG

[76] Inventor: Raymond L. Woodley, 20 Nook Road, Scholes, Leeds LS15 4BU, Yorkshire, England

[21] Appl. No.: 228,448

[22] Filed: Jan. 26, 1981

[51] Int. Cl.[3] ..... D06F 1/00
[52] U.S. Cl. ..... 24/562 R
[58] Field of Search ..... 24/137 R, 130; 128/346

[56] References Cited

U.S. PATENT DOCUMENTS

| | | | |
|---|---|---|---|
| D. 136,737 | 11/1943 | Woock | 24/137 R |
| D. 199,310 | 10/1964 | Rizzuto | 24/137 R |
| 2,496,109 | 1/1950 | Terry | 24/137 R |
| 3,061,263 | 10/1962 | Butler | 128/346 |
| 3,357,674 | 12/1967 | Coanda et al. | 24/130 |

FOREIGN PATENT DOCUMENTS

| | | | |
|---|---|---|---|
| 2042675 | 3/1972 | Fed. Rep. of Germany | 24/137 R |
| 1314400 | 4/1973 | United Kingdom | 24/137 R |

*Primary Examiner*—Robert A. Hafer
*Attorney, Agent, or Firm*—David A. Jackson; Daniel H. Bobis

[57] ABSTRACT

The invention provides a clothes peg, preferably a one-piece moulding of plastics material, comprising a pair of limbs extending from a shoulder region. The limbs converge but spread to parallel condition when pushed over the clothes line, and the resilience of the limbs and strength of the shoulder region hold the peg to the clothes line. Adjacent the shoulder region, the limbs have on their inner faces longitudinally extending ribs having flat clothes line engaging faces, which ensure the effective gripping of the line when the line is adjacent the shoulder region.

7 Claims, 4 Drawing Figures

CLOTHES PEG

This invention relates to a clothes peg for pegging clothes or other articles on a line to dry.

It is known to provide a clothes peg which has a pair of links extending from a shoulder region said links being designed so that they generally converge to the open end, the spacing between the limbs at the open end is slightly less than the diameter of the clothes line over which the peg is to be pushed, so that the limbs spread against the eleasticity of the limbs and by virtue of the connection with the shoulder region to a generally parallel condition when the peg is pushed over the clothes line, and the resiliency of the limbs holds the peg firmly to the rope. If the peg limbs were to spread to too divergent a condition, there would be a tendency for the peg to jump off the clothes line.

Therefore, the peg, usually moulded in plastics material, is specially designed so that the inherent springiness of the limbs and the connection to the shoulder region perform the holding function when the peg is pushed over clothes line.

These pegs are adapted to be used with clothes lines the diameter of which although perhaps standard, vary over a relatively small range and it can happen that, depending upon the spacing of the limbs, and if the smaller diameter clothes lines are used, certainly when the clothes line is adjacent the shoulder region the peg can spin around the rope in use, which is of course disadvantageous. The present invention is directed to overcoming this problem, and in accordance with the invention, a peg as set forth has at least one of the inner faces of said limbs defining at least the space adjacent the shoulder a longitudinally extending rib having a generally flat, clothes line engaging face.

Preferably, each of said inner faces has a said longitudinally extending rib.

Such longitudinally extending ribs serve to engage firmly on clothes lines which are of smaller diameter or carry only flimsy clothes, and by making the surfaces thereof generally flat, the clothes engaged thereby will not be so readily damaged as they can be when the projecting ribs are shaped so that there is line contact between the longitudinally extending ribs and the clothes. I have experimented with longitudinally extending ribs for the purpose as indicated above and which are shaped so that there is line contact with the cothes, and such ribs of such construction tend to damage the clothes. Furthermore, if the pegs are moulded in synthetic plastics material in moulds of identical halves, and the said longitudinally extending projections lie centrally of the limbs of the peg, the mould joint line lies centrally of said ribs.

If the longitudinally extending ribs are shaped so as to have line contact with the clothes line, any residual sprue or flashing of the moulding medium along the mould joint line and hence along the centre of the said ribs, will act as a knife in use and will tend to cut through clothes held by the pegs. By making the said longitudinally extending ribs flat, this disadvantage is obviated or mitigated.

Throughout this specification including the claims the term "longitudinally extending" as applied to ribs, means in the longitudinal direction of the limbs, the term "laterally extending" as applied to ribs means transverse to the longitudinal direction of the limbs, and the term "rib" includes either a continuous ridge or a line of small projections.

It is preferred that the inner faces of the limbs are at an angle of convergence of the order of one or two degrees only which is sufficient to produce a bow effect at the shoulder regions.

Preferably, the said longitudinally extending ribs are formed centrally on the inner faces of said limbs defining each of said faces. The limbs may either be formed with or secured rigidly to the body or handle portion. Preferably, the peg will be formed in one piece from a rigid synthetic plastics material although it may be made from wood, metal or other suitable material.

In order that the invention may be more fully understood and carried into effect one embodiment thereof is illustrated merely by way of example in the accompanying drawing which shows a peg intended to be produced by moulding in one piece from synthetic plastics material. In this drawing.

Figure 1:
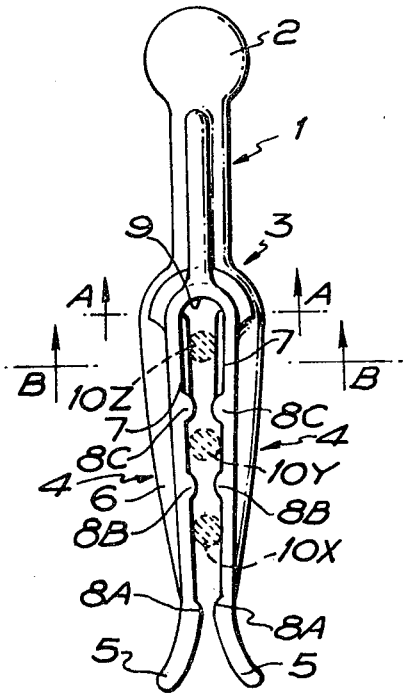
FIGS. 1 and 2 are respectively a front and a side elevation of the peg shown in its unstrained state, that is when not in use.

As shown in this drawing, the peg has a body portion 1 with a head 2 and shoulder region 3 from which latter project a pair of limbs 4, these having their outer ends 5 curved divergently to facilitate application of the peg over a line. A strengthening ribbing 6 extends longitudinally and centrally along the peg from the head 2 to the beginning of the divergent ends 5 to provide strength but still allow the limbs 4 to flex from their points of junction with the shoulder region 3. The particular form of the body or handle portion and strengthening ribbing will, however, be governed by design consideration and moulding requirements.

Figure 2:
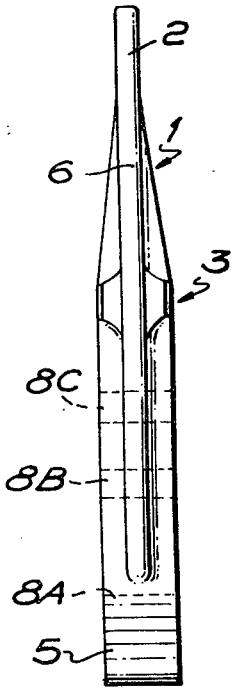
Figure 3:
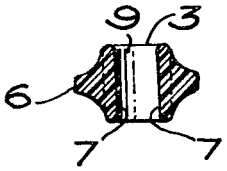
FIG. 3 is a section taken on A—A in FIG. 1.
Figure 4:
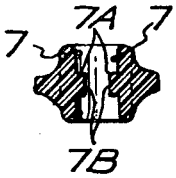
FIG. 4 is a section taken on line B—B in FIG. 1.

Each limb 4 has its inner face 7 lying generally in a plane and these two planes converge slightly towards their open ends at an angle of (say) two degrees to produce a bow effect at the shoulder portion 4. In this embodiment, three pairs of inwardly projecting and laterally extending ribs 8A, 8B, 8C extend the full width straight across the faces 7 as indicated in FIG. 2, these ribs having rounded contours and forming three necks or restricted passages. The ribs 8A are located at the outer ends of the faces 7 where the latter begin to diverge, whilst the ribs 8B and 8C are located at different intervals as illustrated to define three line-locating spaces, the first being between ribs 8A and 8B, the second between ribs 8B and 8C and the third between ribs 8C and the inner face 9 of shoulder region 3. With the ribs projecting a uniform distance from the faces 7, the necks formed between the ribs of each pair will have different widths, for example, 0.063", 0.082P and 0.100" for ribs 8A, 8B and 8C respectively. On the opposed faces 7 which define the space nearest the handle 1, that is, the space between the inner face of shoulder 9 and projections 8C are longitudinally extending ribs 7A, which as shown in FIG. 4, have opposed flat faces 7B, 7B for engaging the clothes line and clothes thereon, for the purpose as herein set forth. The said longitudinally extending ribs may have a laterally extending width of the order of ⅛th to ⅓rd of the laterally extending width of the faces 7, and they are preferably located centrally of the faces 7.

By reason of the above-described construction of peg, the peg can be located on the clothes line 10 in any one of three positions which are indicated in FIG. 1 by 10X, 10Y and 10Z. The first position 10X is suitable for thin or light articles e.g. ladies' stockings), the second 10Y for articles of medium thickness or weight, and the third 10Z for still thicker or heavier articles (e.g. sheet, blankets, curtains). It will be understood that the resilient grip exerted by the limbs on the line will be greater the nearer the line is located to the shoulder face 9. Should it be that a relatively thin clothes line or clothes line with a relatively thin garment thereon is moved to position 10Z, the ribs 7A maintain the grip thereon which might not otherwise exist if the ribs were not provided.

Moreover, the slight convergence of the faces 7 in the peg's unstrained state tends to hold the peg down on the line and to oppose a tendency for the peg to spring upwards and come off the line. Also, the neck formed by the outer pair of ribs 8A acts as a potential guard against the peg coming off the line accidentally.

Of course the resistance to displacement of the peg from the chosen position on the line operates in any of the selected positions.

Whilst this specification and the appended claims refer to the laterally extending ribs defining line-locating spaces and the drawing illustrates laterally extending ribs having a longitudinally extending width less than the distance between adjacent ribs on a face 7 the laterally extending ribs might be made to extend longitudinally considerably more so that the line-locating spaces appear more like grooves in the faces 7, and any such construction which would achieve the stated objects of this invention is to be considered as included within the scope of said claims.

I claim:

1. A one-piece plastics clothes peg comprising a pair of limbs which engage over a clothes line to grip clothes thereto, said limbs extending from a shoulder region so as to converge to an open end and to be resiliently spread when the peg is pushed over the clothes line, and wherein at least one of the inner faces of the limbs adjacent the shoulder region is flat and has a centrally located longitudinally extending rib which has a generally flat face lying parallel to the inner face of the limb so that the flat face of the rib and the portions of the limb face on opposite sides of the rib, form a clothes line engaging face.

2. A clothes peg according to claim 1, wherein each limb has a said longitudinally extending rib which has a generally flat clothes line engaging face.

3. A clothes peg according to claim 2, wherein each limb has a flat inner face, and the flat inner faces converge from the shoulder region to the open end, the convergence being of the order of two or three degrees.

4. A clothes peg according to claim 3, wherein there are pairs of opposed transversely extending ribs projecting from said inner limb faces; the pairs of transversely extending ribs being spaced longitudinally of the limbs.

5. A clothes peg according to claim 4, wherein the longitudinally extending ribs extend from the shoulder region to the pair of transversely extending ribs closest to the shoulder region.

6. A clothes peg according to claim 3, wherein, there is a handle portion extending from the shoulder region.

7. A clothes peg according to claim 3, wherein the longitudinally extending ribs have a width $\frac{1}{8}$th to $\frac{1}{3}$rd of the width of the limb inner faces.

* * * * *